US011052403B2

(12) United States Patent
Lorenz

(10) Patent No.: US 11,052,403 B2
(45) Date of Patent: Jul. 6, 2021

(54) PROTECTION DEVICE FOR TOOL-HOLDERS FOR TOOLS FOR SHREDDING, CUTTING AND COLLECTING MATERIAL

(71) Applicant: Seppi M. spa, Caldaro (IT)

(72) Inventor: Seppi Lorenz, Caldaro (IT)

(73) Assignee: SEPPI M. SPA, Caldaro (IT)

( * ) Notice: Subject to any disclaimer, the term of this patent is extended or adjusted under 35 U.S.C. 154(b) by 109 days.

(21) Appl. No.: 16/202,437

(22) Filed: Nov. 28, 2018

(65) Prior Publication Data

US 2019/0160471 A1 May 30, 2019

(30) Foreign Application Priority Data

Nov. 28, 2017 (IT) ..... 102017000136340

(51) Int. Cl.
*B02C 18/18* (2006.01)
*B02C 13/28* (2006.01)

(52) U.S. Cl.
CPC ..... *B02C 18/18* (2013.01); *B02C 13/2804* (2013.01); *B02C 2018/188* (2013.01)

(58) Field of Classification Search
CPC ..... B02C 18/18; B02C 18/186; B27G 13/00; B27G 13/02; B27G 13/04; B27G 13/08; B27G 13/10; A01G 23/06; A01G 23/067
See application file for complete search history.

(56) References Cited

U.S. PATENT DOCUMENTS

| | | | | |
|---|---|---|---|---|
| 8,061,640 | B2 * | 11/2011 | Cotter | B02C 13/06 241/101.01 |
| 8,550,391 | B2 * | 10/2013 | Denis | B02C 18/184 241/294 |
| 9,137,954 | B2 * | 9/2015 | Leonardi | B23D 61/06 |
| 10,051,798 | B2 * | 8/2018 | Leonardi | A01G 23/067 |
| 2006/0016314 | A1 * | 1/2006 | Gaudreault | A01G 23/08 83/835 |
| 2010/0044487 | A1 | 2/2010 | Labbe et al. | |
| 2017/0079219 | A1 | 3/2017 | Stanley et al. | |
| 2018/0229244 | A1 * | 8/2018 | Kimbell | B02C 18/145 |

FOREIGN PATENT DOCUMENTS

| | | | |
|---|---|---|---|
| CA | 253198 | A | 9/1925 |
| FR | 2 954 673 | A1 | 7/2011 |
| FR | 2 973 721 | A1 | 10/2012 |

* cited by examiner

*Primary Examiner* — Matthew Katcoff
(74) *Attorney, Agent, or Firm* — Jacobson Holman PLLC

(57) ABSTRACT

A protection device for tools for cutters and shredders and the like, arranged on a tool-holder seat for a tool-holder rotor rotatable about the axis of the rotor, said tool being housed in a seat arranged on the tool-bolder rotor, and formed by a first surface arranged at the front in the cutting direction and a second surface onto which the tool is fixed with its opposite surface to the cutting direction, the tool having a body that has a front surface in the rotation direction of the rotor, and a rear surface opposing the front surface. The tool and/or the seat having lateral projections and a protection device is dismountable connected to the seat of the tool, laterally as a protection for the tool and the plates being arranged partially between the lateral projections, of the tool and/or the seat of the tool, and the tool-holder rotor.

4 Claims, 6 Drawing Sheets

PROTECTION DEVICE FOR TOOL-HOLDERS FOR TOOLS FOR SHREDDING, CUTTING AND COLLECTING MATERIAL

BACKGROUND OF THE INVENTION

The present invention refers to a protection device for tool-holders for tools for shredding, cutting and collecting material, according to the identifying section of claim 1.

Tools which are used for shredding and cutting material, for example biomass, can have different configurations for different uses. Different tools can require different cutting depths and lengths of material to be fed.

From US 2017/079219 a ring for the control of cutting and/or shredding is known comprising a cutting depth control ring This ring has a first end and a second end: between the first and the second end a tool-holder is arranged where the ring is connected to the rear part of the tool-holder and at least partially arranged at the front of the body of the cutting tool. The described ring must be mounted on the rotor onto which the tool-holders are fixed. The fixing on the rotor is often expensive and also irreversible.

CA253198 describes a tubular cylindrical base for cutting heads. A series of cutting tools is mounted on the cylindrical base securely fixed on the outer surface. Each cutting tool is associated with a protection which is mounted on the cylindrical surface.

The protection device described is for a tool which is used in particular for a specific type of shredding/cutting of biomass. US 201004487 describes a protection device for shredders that has a seat in which a tool is arranged and side walls to protect said seat. It does not say that the tool and/or the seat locks the protection which allows the plates to be fixed onto each machine or that the seat and/or tool helps to absorb centrifugal forces.

SUMMARY OF THE INVENTION

The objective of the present invention is to realise an easily interchangeable device to also allow the choice of a protection tool when changing the tool and therefore facilitate the use of the machine for shredding/cutting for various sectors more quickly.

This aim is realised by means of a tool-holder for a tool-holder rotor with a protection according the classifying part.

Protection device for a tool for shredders and cutters and the like, arranged in a tool-holder for a tool-holder rotor rotatable about the axis of the rotor, and said tool being housed in a seat of the tool-holder arranged on the tool-holder rotor, the seat being formed by a first surface arranged at the front in the cutting direction and a second surface onto which the tool is fixed with its surface opposite the cutting direction, and the tool having a body that has a front surface in the rotation direction of the rotor, and a rear surface opposing the the front surface. According to the invention the seat of the tool-holder and/or the tool have lateral projections through which the plates are connected by means of a dismountable geometric coupling to the tool-holder seat laterally to the seat, respectively a plate as protection for the tool and to limit the cutting depth, said plates arranged at the front of the tool advantageously having a projection at least partially arranged at the front of the tool.

The objective of the present invention is to realise a machine which collects and shreds the material forming a continuous flow of material and as such guaranteeing uniform shredding of the collected material which can be used with different cutting tools which require or do not require a protection device. Advantageously the plates have an edge with a curvature that is open towards the top. In this way the material to be cut is brought towards the blade of the cutting tool. The generated flow is directed from below towards the blade, creating a flow of material which is shredded more easily by the blade, The fixing of the plate to the tool seat is of removable type; by means of the lateral projections of the seat of the tool-holder and/or tool, the plates are inserted laterally between the projections and the tool-holder rotor and/or the base of the tool-holder.

Advantageously the plates are fixed by means of screws to each other and/or that respectively fix both plates to the seats. In one embodiment the screws are fixed both at the front and at the rear between the plates.

Fixing by means of screws and bolts allows quick mounting and also dismounting and prevents any lateral exit of the plate which are arranged below the projections.

Fixing by means of positioning below the projections allows the seat and the tool-holder to not be drilled, although in one embodiment a screw or a bolt can be envisaged which passes through, the seat to enhance safety.

To allow quick mounting a pin and/or stem of a screw can be provided which connects the two plates and rests on the front side of the tool seat In this way mounting in the correct position is guaranteed. This object is achieved by means of a machine for shredding, collecting and transporting the shredded material according to the classifying part.

DESCRIPTION OF THE DRAWINGS

Further details and characteristics of the invention will become apparent from the claims and the following description of a non limiting preferred embodiment, depicted in the attached drawings, wherein:

Figure 1:
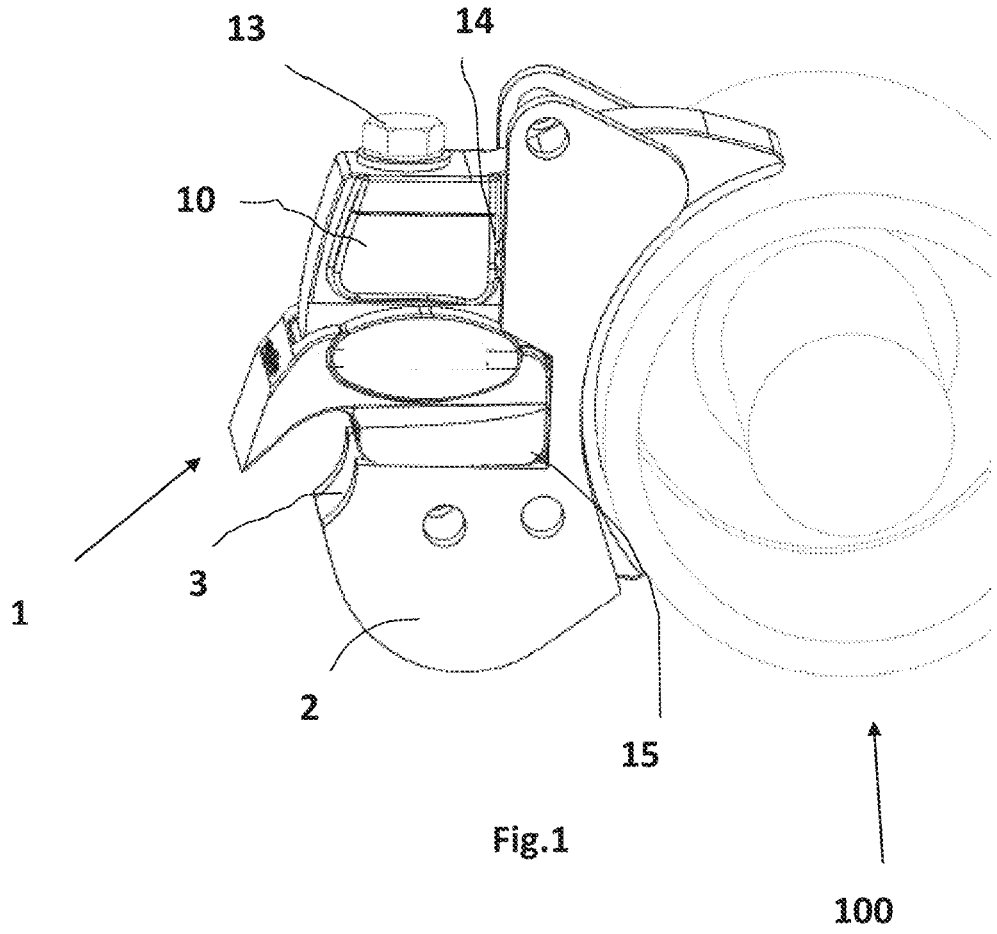
FIG. 1 shows a schematic perspective view of a tool-holder rotor with a protection according to the invention.
Figure 2:
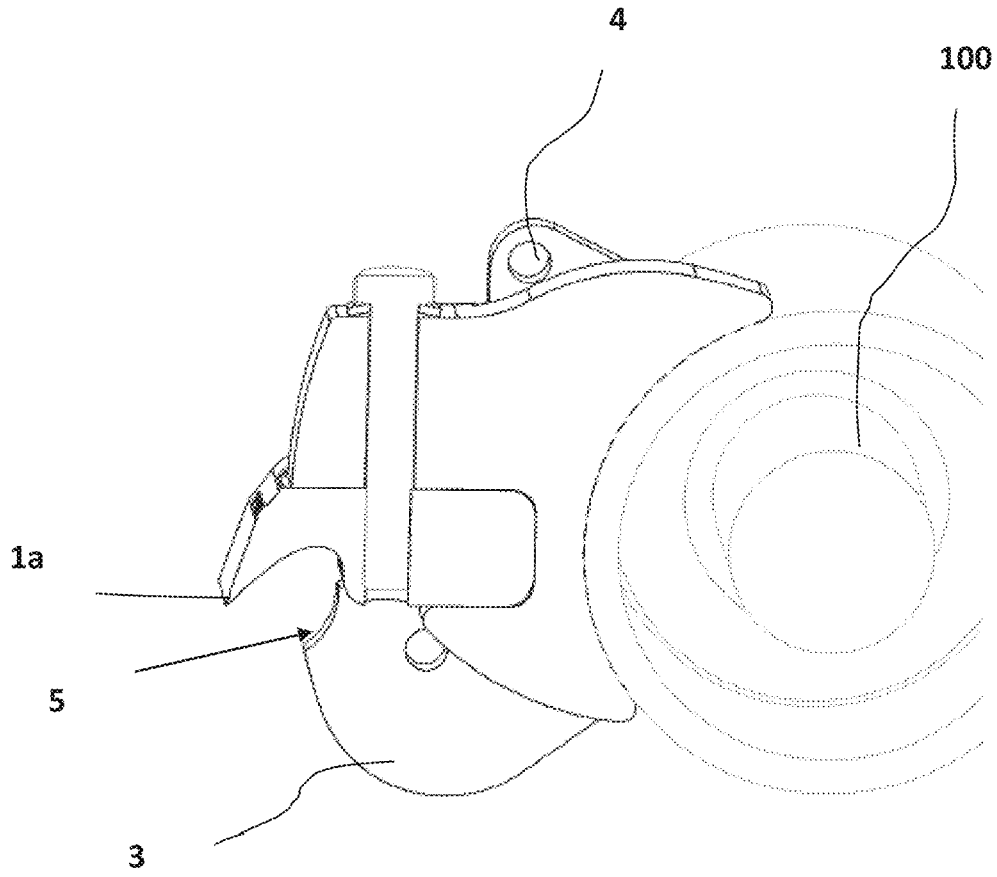
FIG. 2 shows a section of a tool-holder rotor with a protection according to the invention.
Figure 3:
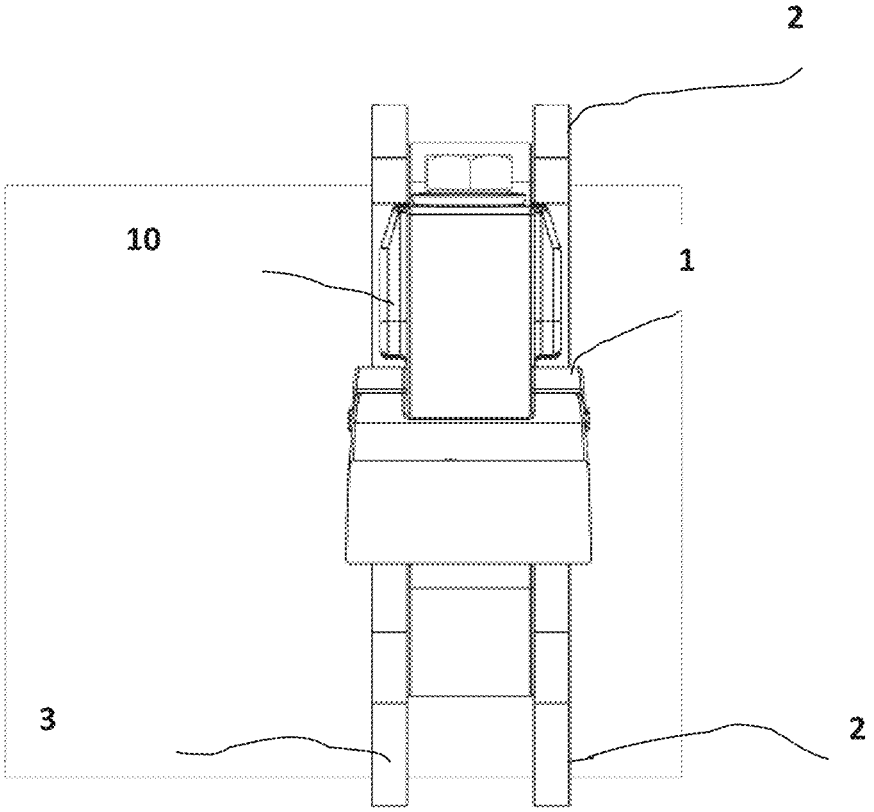
FIG. 3 shows a front view of a section of a tool-holder rotor with a protection according to the invention.
Figure 4:
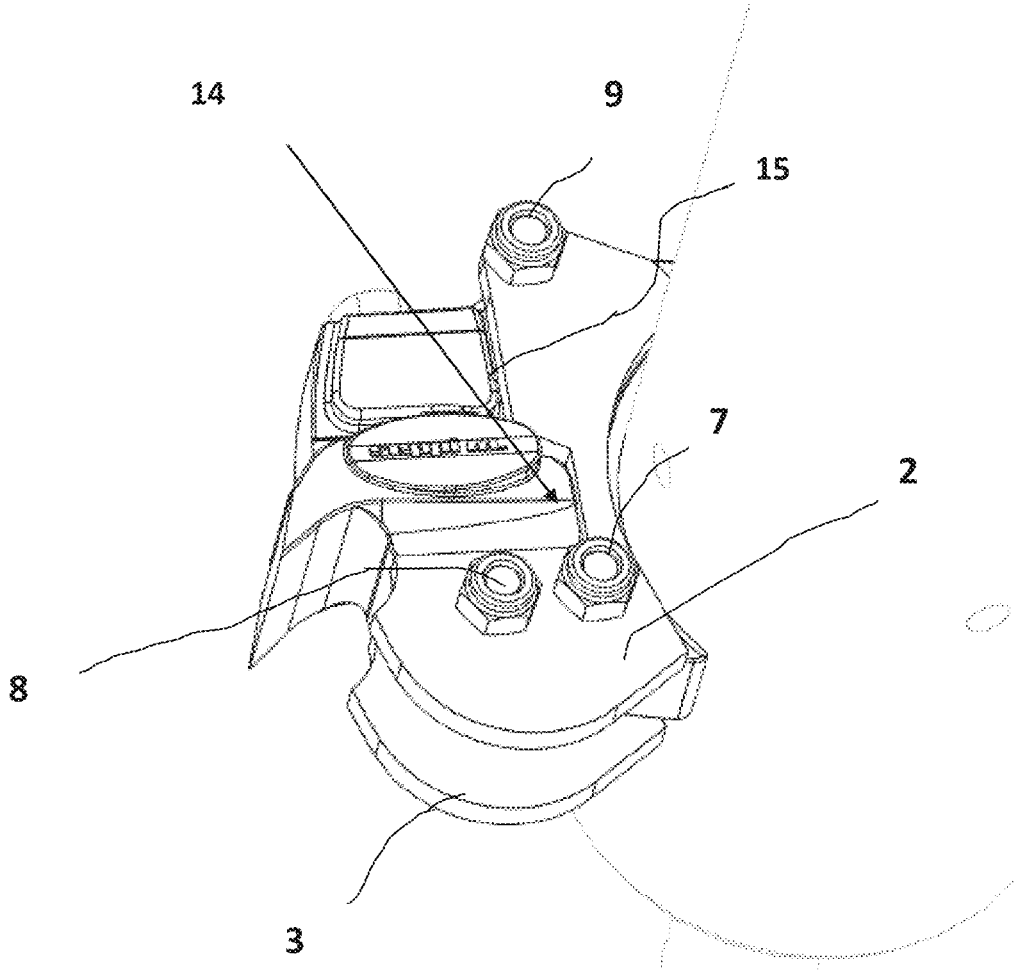
FIG. 4 shows a perspective view of a tool-holder rotor with a protection according to the invention.
Figure 5:
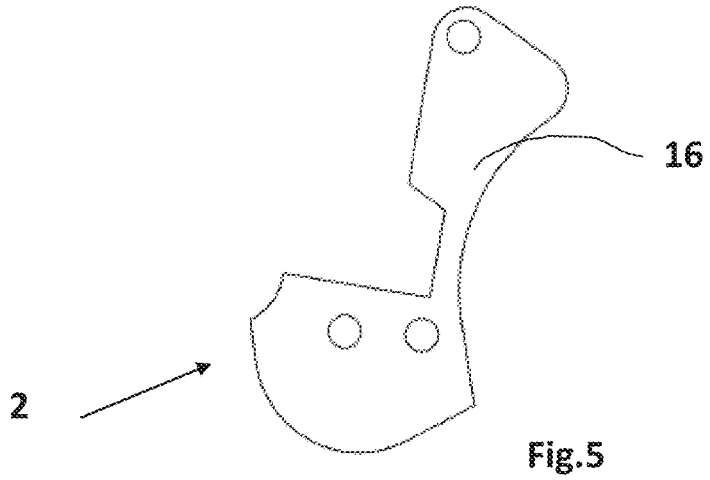
FIG. 5 shows a lateral view of a protection according to the invention.
Figure 6:
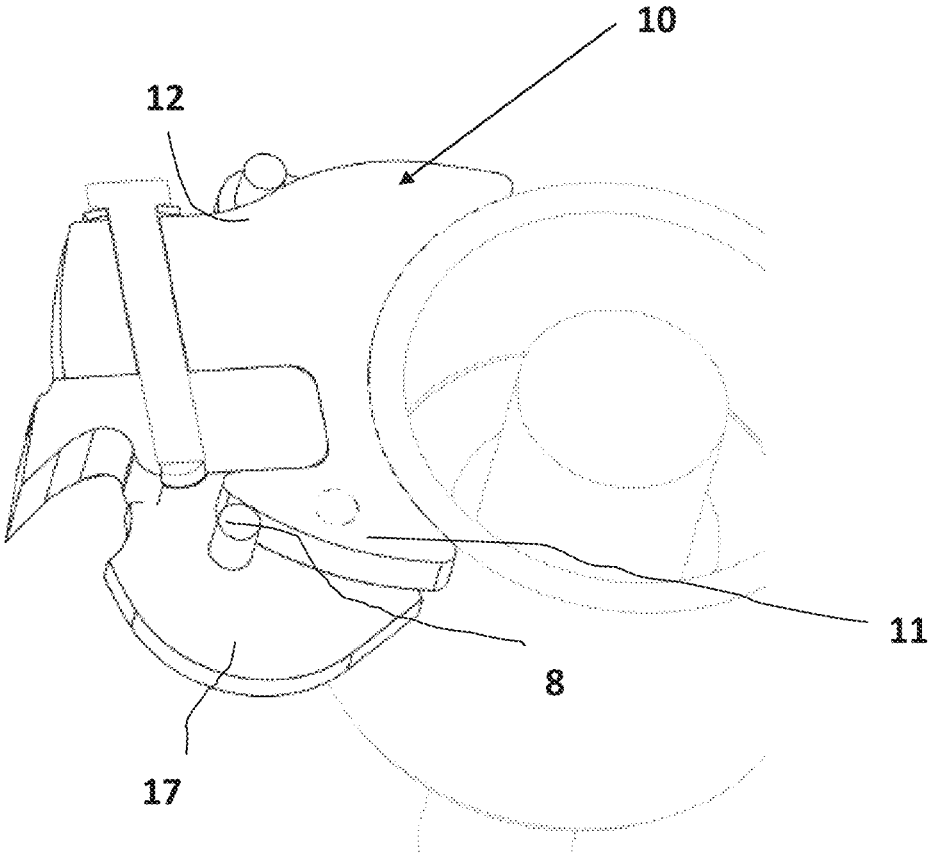
FIG. 6 shows a perspective view of a section of a tool-holder rotor with a protection according to the invention.

DETAILED DESCRIPTION OF THE INVENTION in FIG. 1 a tool-holder rotor is indicated with reference number 100, on which a series of seats for tools 10 is fixed. These seats 10 can be welded to the tool-holder rotor 100. The tool-holder seats are formed by a front part 11 in the cutting direction and a rear part 12, Between the front part 11 and the rear part 12 a tool 1 is inserted. This tool 1 can be inserted by means of a geometric coupling between the front part of seat 11 and the rear part 12, Advantageously the toot 1 can be fixed by means of a bolt 13.

The tool-holder seat 10 and/or the tool have lateral projections 14,15.

For shredding/working different tools can be used according to the material to be processed, if tool 1 used has a particularly sharp cutter 1*a* there is a risk of entanglement of the material. To avoid this jamming the cutting depth of cutter 1 is limited.

According to the invention a plate 16,17 is connected on both sides of the base of the tool-holder seat 10 in a removable way which forms a protection 2,3, This plate 16,17 is inserted between the projection 14,15 and the tool-holder rotor 100. Advantageously on both sides lateral projections of the tool-holder seat 14 and lateral projections of the tool 15 are provided.

Advantageously the plates 16,17 cover the entire base of the tool-holder seat 10 below and at the front and at the rear of projection 14. In this way the tool-holder seat 10 base is protected from any damage due to stones or other materials.

Fixing of the protection is achieved by means of a geometrical coupling. Advantageously protections are connected also with each other by means of bolts 8,9 or the like and these connecting bolts can rest on the outer surface of the tool seat 10 or pass through the tool seat 10.

Advantageously the protections 2,3 are formed so as to have a recess 5 respectively arranged at the front of the tool. This recess is adapted to form a flow of material which is directed from above towards the cutter so as to create a wave. This wave allows a continuous flow of material to be cut.

Figure 7:
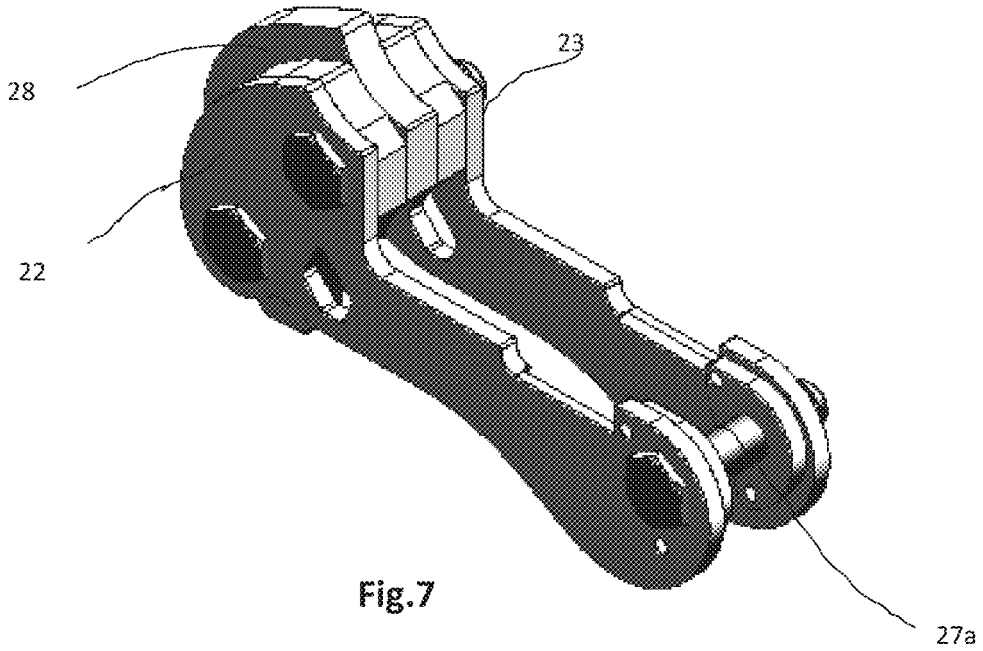
FIG. 7 is a perspective view of a further second embodiment.
Figure 8:
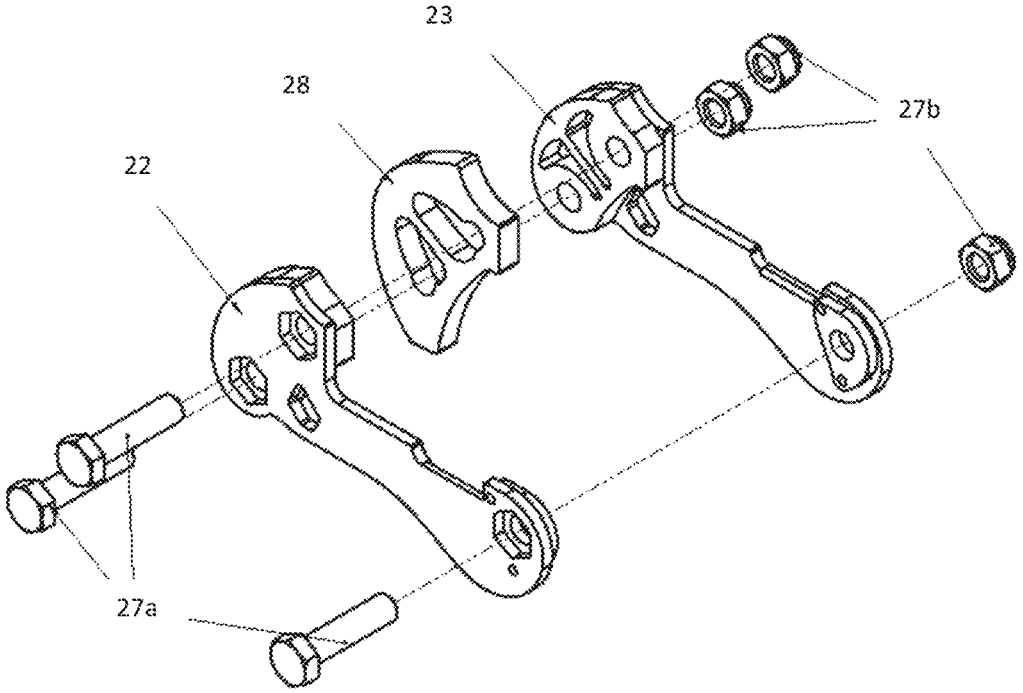
FIG. 8 shows an exploded view of FIG. 7.

In FIG. 7 a further protection for a tool is illustrated in a second embodiment. In this embodiment an insert 28 arranged between the plates 22 and 23 is provided for the tool in the rotation direction. This insert 28 is formed so as to further limit the cutting depth of the tool. Advantageously the insert forms a bowl ready for the tool so as to form a flow of material from below towards the tool maintaining a cutting length limit and to prevent direct impact to the tool. Advantageously the insert is fixed by means of bolts 27*a* and female nuts 27*b* between the plates 22 and 23 and has a projection for limiting the cutting depth.

Finally it is clear that additions, changes or variations to the protection for tools for collection and/or shredding tool 1 described herein can be applied which are obvious to a person skilled in the art without departing from the scope of protection provided by the attached claims.

KEY OF REFERENCE NUMBERS

1. Tool
1. a cutting tool
2. Protection
3. Protection
4. holes
5. recess
7. bolt
8. bolt
9. bolt
10. tool seat
11. front pert of the tool seat
12. rear part of the tool seat
13. bolt
14 lateral projection of the tool seat
15 lateral projection of the tool
16 plate
17 plate
22 plate
23 plate
27*a* bolts
27*b* nuts
28 insert
100 tool-holder rotor

The invention claimed is:

1. An apparatus comprising:

a tool-holder rotor rotatable about an axis;

a tool-holder seat arranged on the tool-holder rotor;

a tool for cutters and shredders being housed in the tool-holder seat and having a cutting direction, wherein the tool-holder seat onto which the tool is fixed comprises a front part in the cutting direction of the tool and a rear part opposite the front part, and wherein the tool comprises a body that has cutting edge in the rotation direction of the tool holder rotor, and a tool lateral projection opposite the cutting edge;

lateral projections are provided on the tool-holder seat or the tool in such a manner that the lateral projections are spaced along the axis of the tool holder rotor;

a protection device connected to the tool-holder seat in a dismountable way by bolts, wherein the protection device comprises two plates arranged on either side of the tool-holder seat.

2. The apparatus according to claim 1, wherein the protection device has a projection arranged at a front of the tool in the rotation direction, for limiting cutting depth.

3. The apparatus according to claim 1, wherein an insert is arranged between the plates provided for the tool in the rotation direction.

4. The apparatus according to claim 3, wherein the insert has a projection for limiting the cutting depth.

* * * * *